US007979959B2

(12) United States Patent
Courtney

(10) Patent No.: US 7,979,959 B2
(45) Date of Patent: Jul. 19, 2011

(54) ACCESSORY FOR A CLEANING APPLIANCE

(75) Inventor: Stephen Benjamin Courtney, Bath (GB)

(73) Assignee: Dyson Technology Limited, Malmesbury (GB)

( * ) Notice: Subject to any disclaimer, the term of this patent is extended or adjusted under 35 U.S.C. 154(b) by 393 days.

(21) Appl. No.: 11/596,173

(22) PCT Filed: Apr. 22, 2005

(86) PCT No.: PCT/GB2005/001571
§ 371 (c)(1),
(2), (4) Date: Nov. 13, 2006

(87) PCT Pub. No.: WO2005/110179
PCT Pub. Date: Nov. 24, 2005

(65) Prior Publication Data

US 2007/0226937 A1 Oct. 4, 2007

(30) Foreign Application Priority Data

May 13, 2004 (GB) ..... 0410698.5

(51) Int. Cl.
*A47L 9/00* (2006.01)

(52) U.S. Cl. ..... 15/415.1; 15/351; 15/411; 15/246.2

(58) Field of Classification Search ..... 15/415.1, 15/351, 411, 246.2; *A47L 9/02, 9/00*
See application file for complete search history.

(56) References Cited

U.S. PATENT DOCUMENTS

| | | | | |
|---|---|---|---|---|
| 5,088,149 | A * | 2/1992 | Berg et al. | 15/322 |
| 5,293,665 | A * | 3/1994 | Worwag | 15/387 |
| 5,950,275 | A * | 9/1999 | Worwag | 15/387 |
| 6,263,539 | B1 * | 7/2001 | Baig | 15/322 |
| D457,696 | S * | 5/2002 | Worwag | D32/32 |
| 6,430,773 | B1 * | 8/2002 | Buron et al. | 15/420 |
| 6,484,356 | B2 * | 11/2002 | Worwag | 15/387 |
| 6,519,810 | B2 * | 2/2003 | Kim | 15/415.1 |
| 6,532,622 | B2 * | 3/2003 | Seon et al. | 15/415.1 |
| 6,550,099 | B2 * | 4/2003 | Worwag | 15/387 |
| 6,553,613 | B2 * | 4/2003 | Onishi et al. | 15/351 |
| 6,571,424 | B2 * | 6/2003 | Roschi et al. | 15/387 |

(Continued)

FOREIGN PATENT DOCUMENTS

| | | | |
|---|---|---|---|
| EP | 0235614 | A1 | 9/1987 |
| EP | 1136029 | A2 | 9/2001 |
| EP | 1356755 | A2 | 10/2003 |
| GB | 2393383 | A | 3/2004 |
| JP | 6-22885 | | 2/1994 |
| WO | WO-03/039315 | A1 | 5/2003 |

*Primary Examiner* — David A Redding

(74) *Attorney, Agent, or Firm* — Morrison & Foerster LLP

(57) ABSTRACT

An accessory for a cleaning appliance includes a head having a housing, a downwardly-directed suction opening in the housing and a neck adapted for attachment to a hose or wand of the cleaning appliance. A rotatable connection is provided between the neck and the head for allowing rotation of the neck relative to the head. A wheel arrangement maneuverably supports the accessory on a surface to be cleaned and is mounted on the neck of the accessory. The wheel arrangement may normally be in contact with the surface to be cleaned, but the point or points of contact between the wheel arrangement and the surface to be cleaned are dependent upon the rotational position of the neck with respect to the head.

9 Claims, 4 Drawing Sheets

U.S. PATENT DOCUMENTS 6,584,640 B2 * 7/2003 Vanderlinden ..... 15/418
6,615,445 B2 * 9/2003 Worwag ..... 15/387
6,695,352 B2 * 2/2004 Park et al. ..... 285/7
7,246,408 B2 * 7/2007 Worwag ..... 15/377
2002/0042967 A1 * 4/2002 Worwag ..... 15/387
2003/0163889 A1 * 9/2003 Bagwell ..... 15/398
2005/0251953 A1 * 11/2005 Hackwell et al. ..... 15/387
2006/0290000 A1 * 12/2006 Worwag et al. ..... 257/768

* cited by examiner

ACCESSORY FOR A CLEANING APPLIANCE

REFERENCE TO RELATED APPLICATIONS

This application is a national stage application under 35 USC 371 of International Application No. PCT/GB2005/001571, filed Apr. 22, 2005, which claims the priority of United Kingdom Application No. 0410698.5, filed May 13, 2004, the contents of both of which prior applications are incorporated herein by reference.

FIELD OF THE INVENTION

The invention relates to an accessory for a cleaning appliance, particularly but not exclusively for a vacuum cleaner.

BACKGROUND OF THE INVENTION

Vacuum cleaners are usually of the upright or cylinder type. Cylinder cleaners consist of a main body containing a motor and fan unit for drawing an airflow into the main body and separating apparatus for extracting dirt and dust from the airflow and retaining it for disposal. The separating apparatus can be a cyclonic arrangement, bags or filters or a combination of these. A hose and wand assembly is connected to the inlet of the main body and an accessory in the form of a floor tool having a suction opening is attached to the end of the wand remote from the main body so that the suction opening can be manoeuvred across the surface to be cleaned by the user. Upright cleaners commonly have a cleaner head permanently attached to the main body of the vacuum cleaner which is manoeuvred, together with the main body, across the surface to be cleaned. However, many upright cleaners can also be operated in the manner of a cylinder machine by having a removable or releasable hose and wand assembly provided to which an accessory such as a floor tool can be attached.

In this context, therefore, the term "accessory" is used to mean a tool which can be attached to a hose and wand assembly forming part of a vacuum cleaner, whether the vacuum cleaner is an upright machine or a cylinder machine, for the purpose of cleaning a floor or other surface. The term is also intended to include accessories which can be used with other cleaning appliances such as steam cleaners, floor polishers and the like.

Many known floor tools consist of a head having a housing which defines a downward-facing suction opening and a neck which is connectable to the wand of the hose and wand assembly of the cleaner with which the floor tool is to be used. Whilst the neck is rotatably connected to the head to accommodate changes in the position of the wand relative to the head during normal use, the wheel arrangement which allows the head to be manoeuvred across the surface is carried by the head. The floor tool thus has no steering capability and so can be awkward to manoeuvre around obstacles located on the surface to be cleaned such as furniture.

SUMMARY OF THE INVENTION

It is an object of the present invention to provide a wheeled accessory for a vacuum cleaner or other cleaning appliance which has improved manoeuvrability in comparison to known accessories.

The invention provides an accessory for a cleaning appliance having a head comprising a housing and a downwardly-directed suction opening, a neck adapted for attachment to a hose or wand of the cleaning appliance, a rotatable connection between the neck and the head for allowing rotation of the neck relative to the head, and a wheel arrangement for manoeuvrably supporting the accessory on a surface to be cleaned, characterised in that the wheel arrangement is mounted on the neck of the accessory.

Preferably, the wheel arrangement is in contact with the surface to be cleaned and the point or points of contact with the surface to be cleaned are dependent upon the rotational position of the neck with respect to the head.

An accessory according the invention is more manoeuvrable than known floor tools and other wheeled accessories.

The wheel arrangement can consist of a pair of spaced-apart wheels arranged on either side of the neck, one of the wheels being lifted away from the surface to be cleaned when, in use, the neck is rotated with respect to the head. In this way, the point of contact with the surface to be cleaned can be changed in dependence upon the position of the neck with respect to the head and this improves the ability of the user to steer the accessory around obstacles.

In a preferred embodiment, the rotatable connection lies in a plane which is inclined to the surface to be cleaned. This improves the steering capability of the arrangement still further as the head will, in use, turn in response to the user applying a twisting force to the wand.

BRIEF DESCRIPTION OF THE DRAWINGS

Embodiments of the invention will now be described with reference to the accompanying drawings, in which.

DETAILED DESCRIPTION OF THE INVENTION

Figure 1:
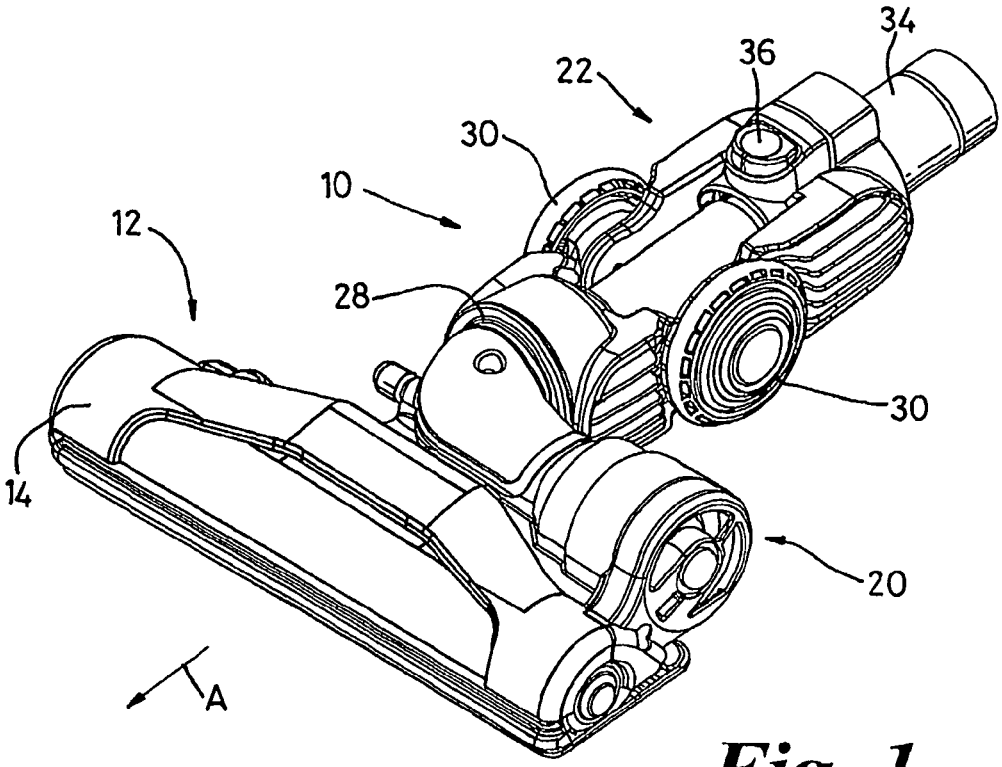
FIG. 1 is a perspective view of an accessory for a cleaning appliance according to the invention.
Figure 2:
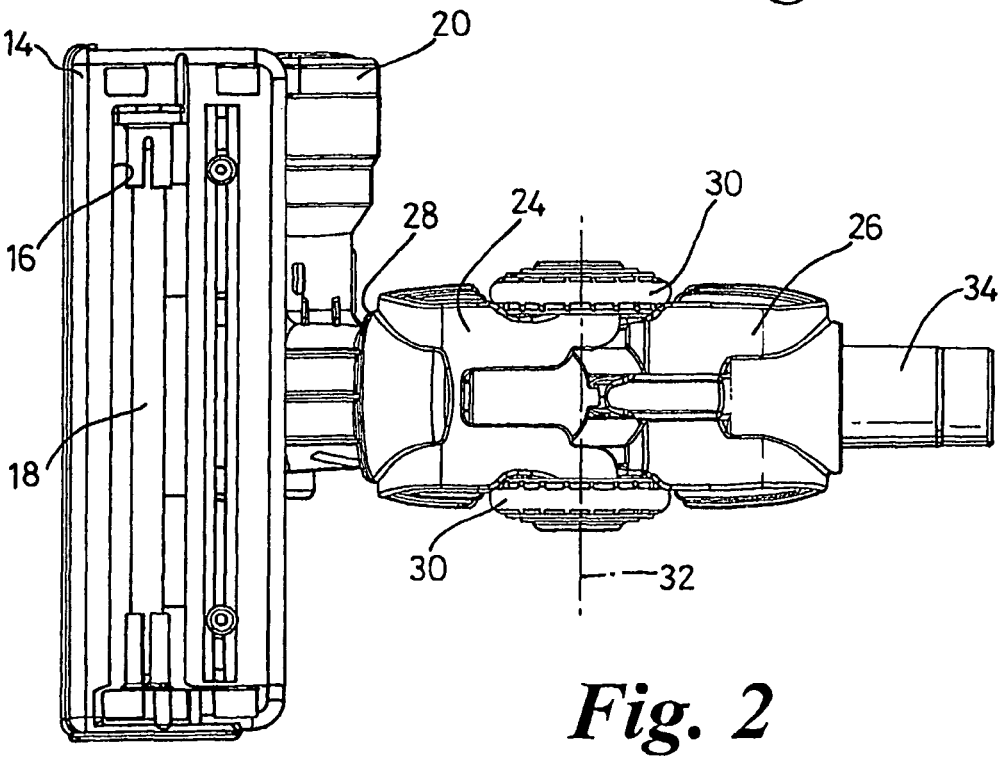
FIG. 2 is an underneath view of the accessory of FIG. 1.

FIGS. 1 and 2 show a floor tool 10 which forms an accessory for a vacuum cleaner according to the invention. The floor tool 10 has a head 12 formed by a housing 14 which has a suction opening 16 formed in the lower surface thereof. A rotatable brush bar 18 is supported in the housing 14 immediately above the suction opening 16 so that the bristles or beaters carried by the brush bar 18 project through the suction opening 16 as the brush bar 18 rotates and agitate the surface to be cleaned. The brush bar 18 is driven by means of a turbine 20, through which air is drawn by the motor of the vacuum cleaner, and a drive belt (not shown). The precise configuration of the housing 14, the location of the brush bar 18 and the means by which it is driven are immaterial to the present invention and will not be described any further here.

The floor tool 10 also includes a neck 22 which has a forward portion 24 and a rearward portion 26. The forward portion 24 is connected to the head 12 via a rotatable coupling 28 which will be described in more detail below. The forward portion 24 extends generally away from the head 12 and carries two wheels 30 which are rotatably mounted on the forward portion 24. The rearward portion 26 is pivotably connected to the forward portion 24 about an axis which coincides with the axis 32 about which the wheels 30 rotate. The rearward portion 26 has a collar 34, projecting away from the forward portion 24, for receiving a wand or hose attached to the main body of the vacuum cleaner with which the floor tool 10 is to be used. A catch 36 is provided on the rearward portion 26 for the purpose of retaining the hose or wand on the collar 34, but this can be omitted if desired.

Figure 3A:
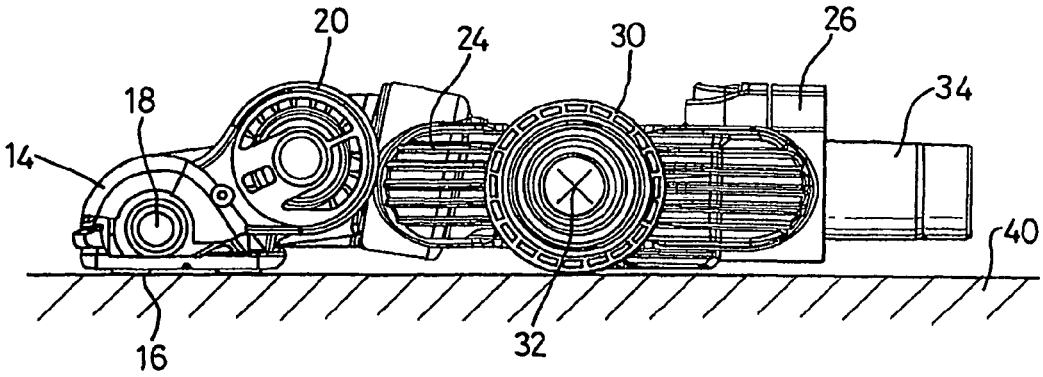
FIG. 3*a* is a side view of the accessory of FIG. 1 in a first position.
Figure 3B:
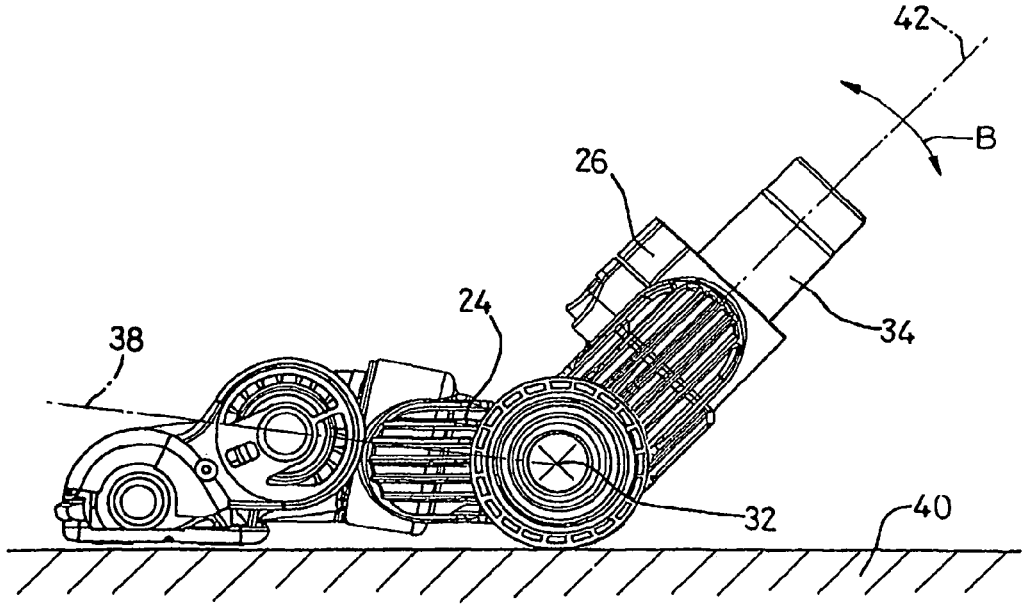
FIG. 3*b* is a side view of the accessory of FIG. 1 in a second position.

The wheels 30 are spaced apart in a lateral direction, ie. in a direction perpendicular to the normal direction of travel of the floor tool 10, which is indicted by arrow A shown in FIG. 1. The wheels 30 thus lie symmetrically on either side of the neck 22 of the floor tool 10 behind the head 12 and behind the rotatable coupling 28. Each wheel 30 is dimensioned so that, when the suction opening 16 lies parallel to the surface to be cleaned, and the forward portion 24 is substantially horizontal, the wheels 30 are in contact with the surface to be cleaned. This is illustrated in FIG. 3*a*. The wheels 30 thus support the floor tool 10 and allow it to be manoeuvred across the surface to be cleaned 40. Illustrated in FIG. 3*b* is the ability of the rearward portion 26 of the neck 22 to pivot with respect to the forward portion 24 about the axis 32. This movement is necessary to accommodate changes in the inclination with respect to the floor (see arrow B) of a wand (not shown) attached to the collar 34 during normal use in which the floor tool 10 is pushed forwards and pulled backwards across the floor 40.

FIGS. 3*a* and 3*b* also show the rotatable coupling 28 by means of which the neck 22 of the floor tool 10 is attached to the head 14. The rotatable coupling 28 comprises two concentrically located collars, one located on each of the head 12 and the neck 22, which are able to rotate with respect to one another. The axis 38 about which the collars are able to rotate is inclined to the surface to be cleaned 40, see FIG. 3*b*. The reason for the inclination of the axis 38 will be explained in more detail below.

Figure 4A:
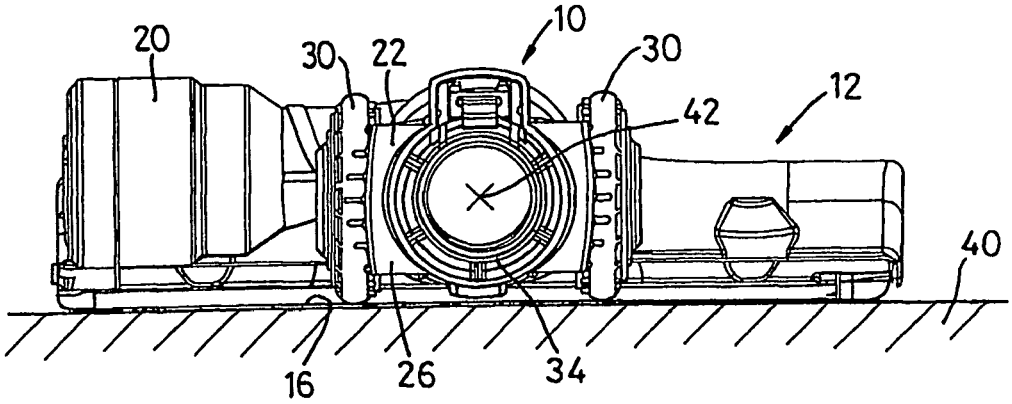
FIG. 4*a* is a rear view of the accessory of FIG. 1 in normal use.

FIG. 4*a* shows the floor tool 10 from the rear when it is in normal use. The head 12 lies horizontally on the surface to be cleaned 40 so that the suction opening 16 lies parallel to the floor 40. When the collar 34 is attached to a hose and wand assembly of a vacuum cleaner and the motor is turned on, an airflow is drawn into the floor tool 10 through the suction opening 16 and dirt and debris is drawn into the floor tool 10 with the airflow. Simultaneously, air is drawn into the floor tool 10 via the turbine 20 so that the brush bar 18 is driven about its axis and the floor covering is agitated so as to release as much dirt and dust as possible from the floor covering. The airflow is passed along the neck 22 of the floor tool to the hose and wand assembly and from there to the separating apparatus of the vacuum cleaner where the dirt and dust are separated and retained whilst cleaned air is returned to the atmosphere.

Figure 4B:
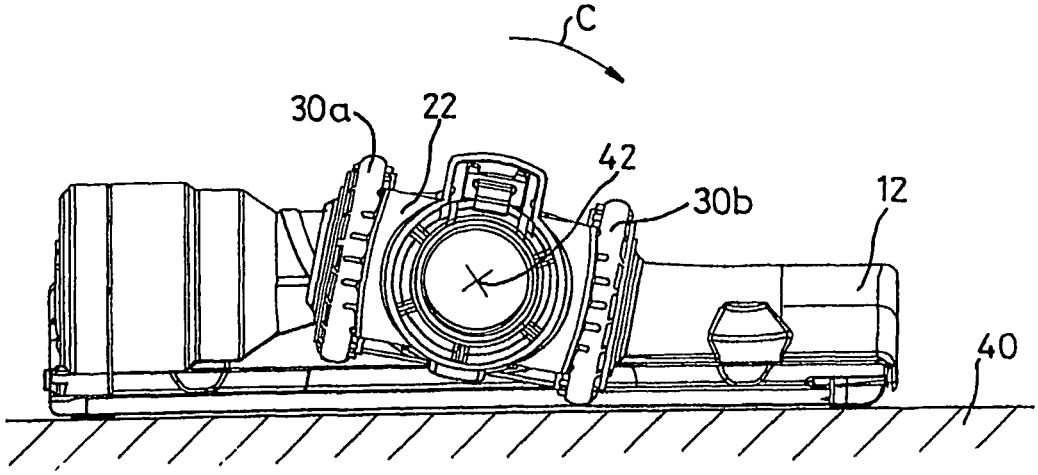
FIG. 4*b* is a rear view of the accessory of FIG. 1 turning to the right.
Figure 4C:
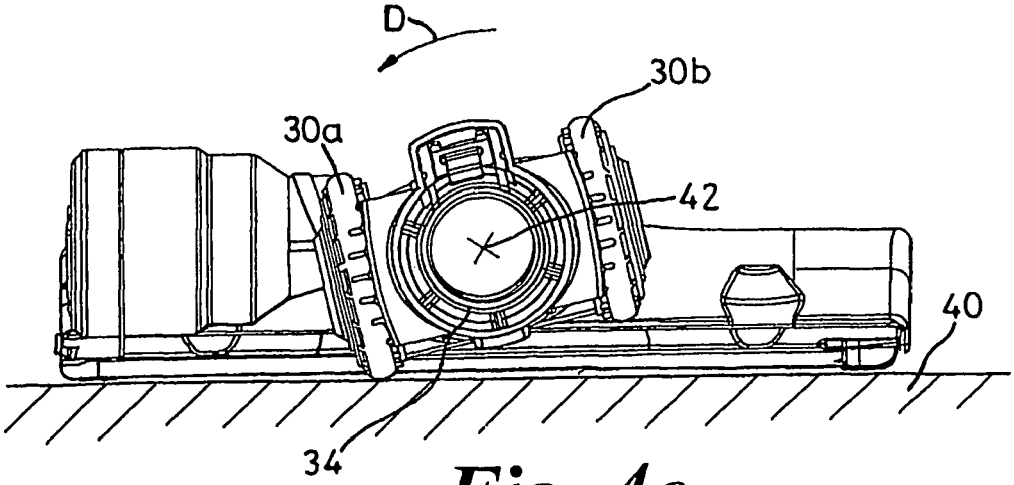
FIG. 4*c* is a rear view of the accessory of FIG. 1 turning to the left.

In the position shown in FIG. 4*a*, the wheels 30 of the floor tool 30 are both in contact with the surface 40. Consequently, the two points of contact with the floor 40 are symmetrically positioned about the centre of the neck 22. Changes in the angle at which the wand attached to the collar 34 lies with respect to the floor 40 are accommodated by pivotal movement of the rearward portion 26 of the neck 22 as shown in FIGS. 3*a* and 3*b*. However, the fact that the wheels 30 are mounted on the neck 22 means that the wand attached to the collar 34 can be twisted about the longitudinal axis of the wand (which is coincident with the longitudinal axis 42 of the collar 34 shown in FIG. 3*b*) to effect steering of the floor tool 10. This is achieved by turning the neck 22 of the floor tool 10 as shown in FIGS. 4*b* and 4*c*. In FIG. 4*b*, the wand is twisted about its axis in a clockwise direction so that the neck 22 is similarly twisted in a clockwise direction about the axis 42, see arrow C. This results in the left-hand wheel 30*a* being lifted away from the floor 40 so that the only point of contact with the floor 40 is the lower edge of the right-hand wheel 30*b* which is located to the right of the neck 22. This arrangement having an asymmetrical point of contact (about the centre of the floor tool 10) provides a greater steering capacity than the arrangement of FIG. 4*a* in which the point of contact with the floor 40 is symmetrically arranged about the neck 22. It allows the floor tool 10 to be turned to the right with greater ease than would be the case if both wheels 30*a*, 30*b* remained in contact with the floor 40.

In a similar manner, FIG. 4*c* shows the position of the floor tool 10 from the rear when the wand is twisted in an anticlockwise direction, thus causing the collar 34 to twist in an anticlockwise direction about the axis 42, see arrow D. In this case, the left-hand wheel 30*a* remains in contact with the floor 40 whilst the right-hand wheel 30*b* is lifted away therefrom. As before, the point of contact changes from a symmetrical arrangement to an asymmetrical arrangement with the point of contact now located only to the left of the neck 22. In this position, the floor tool 10 can be turned to the left with greater ease than would be the case if both wheels 30*a*, 30*b* were in contact with the floor 40.

It will be appreciated that, whilst FIGS. 4*b* and 4*c* illustrate the neck 22 with the rearward portion 26 in a generally horizontal position, the twisting movement can be carried out with the rearward portion 26 inclined to the vertical as shown in FIG. 3*b*.

The rotatable coupling 28 described above allows the neck 22 to rotate with respect to the head 12 in a plane which lies generally perpendicular to the forward direction of travel of the floor tool 10 (illustrated by arrow A in FIG. 1). This is important because, when the neck 22 is turned so as to lift one of the wheels 30 away from the floor 40, it is highly desirable for the head 12 to remain parallel to the floor so that the suction opening 16 also remains parallel to the floor. If the suction opening were to be tilted, the pick-up performance of the floor tool 10 would be affected, partly because air would be bled into the tool between the housing and the floor, and partly because the brush bar would not operate at its optimum distance from the floor covering. The swivel capability of the rotatable coupling 28 allows the suction opening 16 to remain flat on the floor 40 when the neck 22 of the floor tool 10 is twisted.

As has been mentioned above, the rotatable coupling 28 allows the collars of the coupling 28 to rotate with respect to one another about an axis 38 which is inclined to the surface to be cleaned 40. The reason for this is that, when the wand is twisted about the axis 42 as described above, the inclination of the axis 38 causes the head 12 of the floor tool 10 to turn in the same direction as the twisting action. Thus, if the wand is twisted to the right, as described in connection with FIG. 4*b*, and the left-hand wheel 30*a* is lifted from the ground, the head 12 will turn towards the right, thus increasing the ease with which the floor tool 10 can be steered around obstacles. Similarly, if the wand is twisted to the left so that the right-hand wheel 30*b* is lifted from the ground, the head 12 will turn towards the left and thus the steering capability of the floor tool 10 is improved in that direction. Under these conditions, the head 12 remains flat against the floor 40 so that the suction opening 16 lies parallel to the floor and pick-up performance is not compromised.

In the embodiment described above, the tilting of the neck 22 of the floor tool 10 essentially involves lifting one of the wheels 30 away from the floor. In order to facilitate this movement, the cross-sectional shape of the rim of each of the wheels 30 is rounded as shown in FIGS. 4*a* to 4*c*. This minimises the torque required to cause the turning movement to be carried out. However, the lateral position of the point of contact between each wheel 30 and the floor remains approximately the same when the neck 22 is tilted. Nevertheless, the number of points of contact between the wheels 30 and the surface to be cleaned 40 is dependent upon the twisting movement of the wand and thus the rotational position of the neck 22 with respect to the head 12.

Figure 5A:
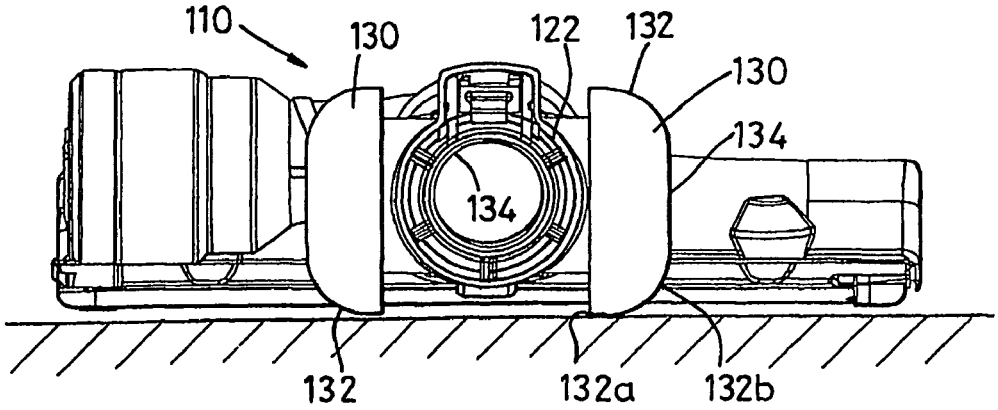
FIGS. 5*a*, 5*b* and 5*c* are rear views of an alternative accessory according to the invention shown in normal use, turning to the right and turning to the left respectively.
Figure 5B:
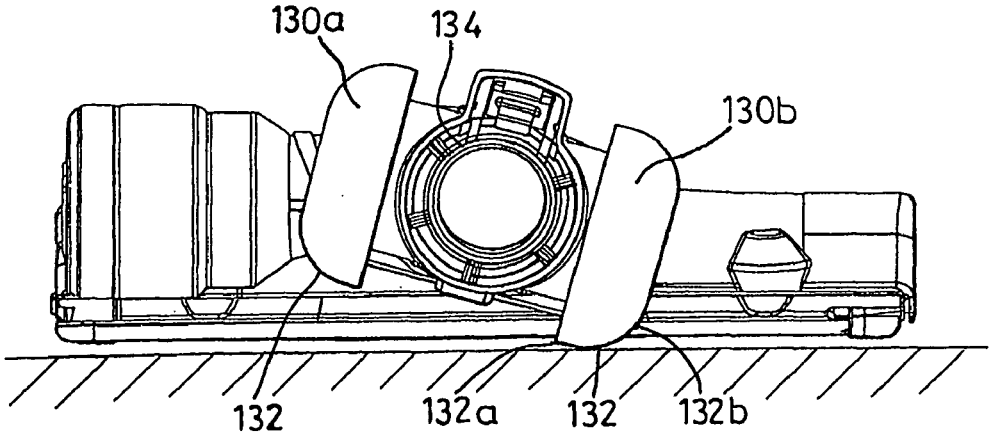
Figure 5C:
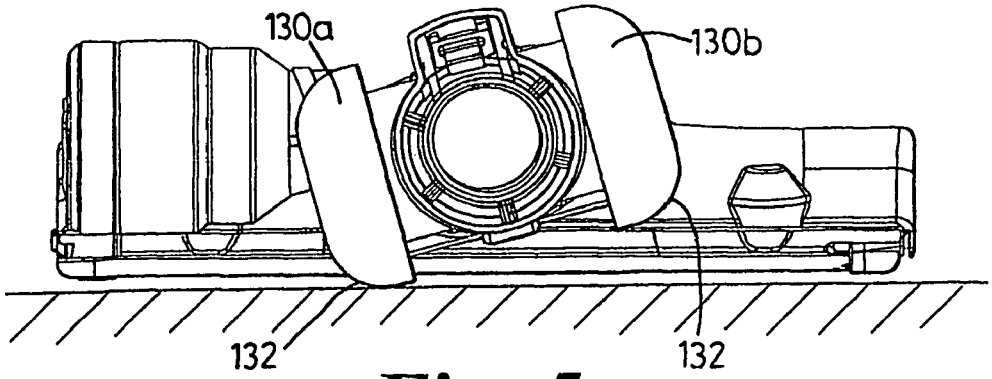

A second embodiment of the invention is shown in FIGS. 5*a* to 5*c*. The only differences between the floor tool 110 shown in FIGS. 5*a* to 5*c* and the previously described embodiment are the size and shape of the wheels 130. In the second embodiment, the wheels 130 are relatively wide and have a rim 132 which is arcuately shaped in the lateral direction. The rim 132 has a maximum diameter at the point 132*a* closest to the neck 122 and a minimum diameter at the point 132*b* where it merges with the side portion 134 of the wheel 130. Between the points 132*a* and 132*b*, the rim has a cross-section which is part-circular in shape. The remainder of the floor tool 110 is identical with the floor tool 10 described above. When the floor tool 110 is in normal use as shown in FIG. 5*a*, the innermost portions of the rim 132 of each wheel 130 (ie. the points 132*a* of maximum diameter) will be in contact with the surface to be cleaned.

When the wand attached to the collar 134 is twisted in the clockwise direction as shown in FIG. 5*b*, the left-hand wheel 130*a* is lifted away from the floor so that there is no point of contact between the wheel 130*a* and the floor. The sole point of contact is thus the rim 132 of the right-hand wheel 130*b*. Initially, when the angle of twist is small, the point of contact will remain at or near the point 132*a* of maximum diameter. However, as the angle of twist increases, the point of contact will move towards the point 132*b* of minimum diameter. This is due to the width of the wheels 130 and the arcuate shape of the rim 132. Similarly, when the wand is twisted in the opposite direction, ie. anti-clockwise, the right-hand wheel 130*b* will be lifted away from the floor and the sole point of contact will be between the rim 132 of the left-hand wheel 130*a*, with the position of the point of contact being dependent upon the angle of twist of the wand. As the angle of the twist of the wand increases, so does the manoeuvrability of the floor tool 110.

The invention is not intended to be limited to the precise details of the embodiments described above and variations and modifications will be apparent to a skilled reader. For example, the floor tool need not include a turbine designed to drive the brush bar or, indeed, a brush bar.

The invention claimed is:

1. An accessory for a cleaning appliance having a head, comprising a housing and a downwardly-directed suction opening, a neck configured for attachment to a hose or wand of the cleaning appliance, a rotatable connection between the neck and the head for allowing rotation of the neck relative to the head, and a wheel arrangement mounted on the neck of the accessory and supporting the accessory on a surface to be cleaned, wherein the wheel arrangement comprises a pair of spaced-apart wheels arranged on either side of the neck, the wheel arrangement being configured so that when in use only one of the wheels is lifted away from the surface to be cleaned when the neck is rotated with respect to the head.

2. An accessory as claimed in claim 1, wherein, in use, the wheel arrangement is in contact with the surface to be cleaned and the point or points of contact with the surface to be cleaned are dependent upon a rotational position of the neck with respect to the head.

3. An accessory as claimed in claim 1, wherein the rim of each wheel is curved.

4. An accessory as claimed in claim 3, wherein the rim of each wheel has a part-circular shape.

5. An accessory as claimed in claim 1, 2, or 3, wherein the rotatable connection allows relative rotation between the head and the neck about an axis which is inclined to the surface to be cleaned.

6. An accessory as claimed in claim 1, 2, or 3, wherein the neck has a forward portion and a rearward portion and the rearward portion is rotatably connected to the forward portion.

7. An accessory as claimed in claim 6, wherein the rearward portion is rotatably connected to the forward portion about an axis which coincides with an axis of the wheel arrangement.

8. An accessory as claimed in claim 1, 2, or 3, wherein the accessory is a floor tool.

9. An accessory for a cleaning appliance having a head, comprising:

a housing and a downwardly-directed suction opening, a neck configured for attachment to a hose or wand of the cleaning appliance, a rotatable connection between the neck and the head, the rotatable connection allowing the neck to rotate relative to the head around an axis of rotation that is substantially parallel to a direction of airflow through the neck, a pair of wheels mounted on opposite sides of the neck of the accessory and supporting the accessory on a surface to be cleaned, and wherein the pair of wheels are configured so that when in use only one of the wheels is lifted away from the surface to be cleaned when the neck is rotated, at the rotatable connection, with respect to the head.

* * * * *